US006489623B1

(12) United States Patent
Peters et al.

(10) Patent No.: US 6,489,623 B1
(45) Date of Patent: Dec. 3, 2002

(54) SHIPPING CONTAINER FOR RADIOACTIVE MATERIALS AND METHODS OF FABRICATION

(75) Inventors: William Carter Peters, Wilmington, NC (US); David Grey Smith, Leland, NC (US); Roger Evan Strine, Wilmington, NC (US); Lon E. Paulson, Wilmington, NC (US)

(73) Assignee: Global Nuclear Fuel -- Americas, LLC, Wilmington, NC (US)

( * ) Notice: Subject to any disclaimer, the term of this patent is extended or adjusted under 35 U.S.C. 154(b) by 93 days.

(21) Appl. No.: 09/706,868

(22) Filed: Nov. 7, 2000

(51) Int. Cl.[7] ..... G21F 5/00; G21F 1/00; G21C 11/00

(52) U.S. Cl. ..... 250/506.1; 250/515.1; 250/517.1

(58) Field of Search ..... 376/260, 287, 376/272, 279; 109/3; 250/506.1, 515.1, 517.1

(56) References Cited

U.S. PATENT DOCUMENTS 3,982,134 A * 9/1976 Housholder et al. ..... 250/506.1
4,100,860 A * 7/1978 Gablin et al. ..... 109/23
4,704,539 A * 11/1987 Dequesnes et al. ..... 105/238.1
4,818,878 A * 4/1989 Popp et al. ..... 220/23.87
6,163,391 A * 12/2000 Strine et al. ..... 250/506.1
6,299,950 B1 * 10/2001 Byington et al. ..... 250/506.1

* cited by examiner

*Primary Examiner*—Jack Berman
*Assistant Examiner*—Kalimah Fernandez
(74) *Attorney, Agent, or Firm*—Nixon & Vanderhye

(57) ABSTRACT

The shipping container includes an outer container body, an inner containment vessel housing a pair of superposed product pails and a self-extinguishing fire-retardant foam insulation layer between the outer container and inner vessel. The inner vessel includes a gusseted upper flange and a lid bolted to the flange with a sealing gasket therebetween. Upper and lower dunnages are provided at the upper and lower ends of the outer container. The upper dunnage includes ceramic fiberboard panels and foam material straddled by steel sheets and additional ceramic fiberboard panel to separate the lid of the vessel and the top of the container. The top is secured to the outer container body by bolts passing through the top and internally into tapped bolt brackets along an interior wall of the outer container body. A retaining ring secures the arcuate overlying rolled edge of the top about the beaded rim of the outer container body. A reinforced plate covers the seam of the outer container underneath the retaining ring bolt for additional container integrity. Vent holes with plastic plugs which melt in response to a predetermined temperature vent the container body to preclude pressure buildup within the container body by expanding gases.

29 Claims, 16 Drawing Sheets

SHIPPING CONTAINER FOR RADIOACTIVE MATERIALS AND METHODS OF FABRICATION

BACKGROUND OF THE INVENTION

The present invention relates to a shipping container for shipping radioactive materials such as low enriched uranium powder, pellets and scrap material and particularly relates to a shipping container for radioactive materials having improved protection for the radioactive materials, as well as affording shipping economy.

Over the years, various types of shipping containers have been designed specifically for shipping radioactive materials, for example, low enrichment uranium oxide powder, pellets or radioactive scrap. One form of prior shipping containers essentially comprised 55-gallon drum-type vessels with inner steel compartments for two 5-gallon pails of radioactive material. Experience with these containers, and over time, have brought to the fore certain problems associated with their use. For example, such shipping containers were typically fabricated from standard 18-gauge carbon steel and the product pails were standard 24-gauge carbon steel. Not only were the containers and pails susceptible to rust and corrosion, but were also susceptible to denting and deformation due to routine industrial handling. Further, those early designs were not sized for optimal loading into currently commercial sea vans. This not only reduced the amount of floor space that could be efficiently used in sea vans but it also required additional bracing and supports to keep the containers from shifting during transport.

Additionally, new regulations, both in the United States and abroad, relating to the shipment of radioactive materials have required a higher degree of structural integrity, resistance to fire and watertightness for the containers than previously applied to older container designs. From the regulatory perspective, neither the inner container drum nor the radioactive material product pails should lose their integrity. That is, the sealed inner containment drum inside the outer drum should not allow contents to leak out or allow water to leak in. Similarly, the product pails should not allow the radioactive material contents to spill. A high degree of resistance to fire is also an important requirement. As a result of the restrictions on structural integrity, fire resistance and watertightness, the radioactive material-carrying capacity per drum of older-style containers has been significantly downgraded.

More particularly, in certain instances, older containers have been found to have significant amounts of rust, including rust on the internal surfaces, which are not capable of inspection without destroying the container. Further, the insulating material has proven to be difficult to fabricate and install, especially in a manner to ensure that the insulation is homogeneous without voids or holes in the region between the inner vessel and outer drum. Further, many of the fixturing devices such as bolts and other securing devices of the older-style containers have been fabricated from typical industrial-grade materials rather than nuclear-grade materials, as consistent with current regulatory requirements. The size and geometry of the older-style containers also is not optimal for loading into standardized sea vans. Such older-style containers achieve a utilization space of only about 38%, while the factor for the present invention is 57%.

The overall regulatory objective of safety for this type of container is principally to ensure avoidance of any possibility of a criticality accident during transportation of special nuclear materials. Both the foreign and domestic regulatory requirements specify that shipping containers for special nuclear materials must undergo a number of tests, such as drop, burn and water intrusion tests, the results of which must be taken into consideration in the safety analysis submitted in support of licensing.

A recent effort by the assignee hereof has resulted in a container for high-density shipment of uranium oxide powder and pellets. Such newer container design employs stainless steel materials for fabrication with silicon rubber gaskets and heavy-duty locking rings for positive leak-tight seals. Fire retardant foam and ceramic fiberboard panel are also employed in such newer-style container to protect the contents against the effect of accident and fire. Moreover, the size and geometry is cubical rather than cylindrical and its inner containers are nine in number, arranged in a 3×3 array. This newer container is the subject of U.S. patent application Ser. No. 09/315,729, titled "Uranium Oxide Shipping Container," filed May 21, 1999.

BRIEF SUMMARY OF THE INVENTION

In accordance with a preferred embodiment of the present invention, there is provided a container for shipping radioactive material comprised of an outer container and an inner containment vessel for receiving and containing product pails. Particularly, the outer container comprises a generally cylindrical container open at its upper end. Bolt brackets are arranged about the inner periphery of the container for receiving bolts to bolt a top onto the container. The bolt brackets are arranged, preferably in 90° sectors spaced about the circumference of the container with a pair of brackets straddling the container's weld seam to reinforce the container when the top is installed. In addition to bolting the top to the container, a retaining ring clamps the top to the container, with a bolt securing end lugs of the retainer ring to one another. The bolt and lugs in the retaining ring are located as close to the outside wall of the outer drum as possible to avoid breakage of containment should the container be dropped or impacted.

The inner containment vessel is generally cylindrical and has a radially outwardly directed flange at its open upper end supported by a plurality of circumferentially spaced gussets to provide strength to the lid-sealing region of the vessel. A lid is bolted to the flange with a heat-resistant gasket therebetween to effect a water seal. The vessel also includes a plurality of spiders or rods which project outwardly, preferably radially, to maintain the vessel centered within the outer container. Between the inner vessel and the outer container is a heat retardant polyurethane foam. The foam limits the maximum temperature the inner containment vessel and its gasket are subjected to, for example, during a fire. The foam also protects the inner containment drum from impact forces resulting from drop and impact tests. Panels formed of neutron-absorbing poisons may also be optionally applied about the exterior surface of the inner vessel.

Upper and lower dunnages are provided at opposite ends of the outer container. The dunnages comprise foam and ceramic fiberboard panels for fire resistance. The upper dunnage includes foam disposed between a pair of circular ceramic fiberboard panels with each having a stainless steel overlay. A reduced combined stainless steel and ceramic fiberboard panel underlies the upper dunnage for reception within the lid of the inner vessel to maintain stability. The lower dunnage is likewise a combination of foam and ceramic fiberboard panels.

The inner containment vessel is permanently fixed within the outer container. For shipping, product pails are placed inside the inner containment vessel. When the lid is bolted to the inner vessel, the upper dunnage is disposed between the lid and the top of the outer container. The upper dunnage is also provided with circumferential slots to enable the upper dunnage to be lowered into the container and pass the bolt connections for disposition on top of the inner vessel container.

Further, to improve resistance to fire, a plurality of plastic-filled vent holes are provided about the outer container and the upper and lower dunnages. The plastic plugs prevent water intrusion during normal conditions but will melt away in a fire to vent the container thereby preventing buildup of gases within the container in the event sufficient heat is supplied to ignite and burn the foam. Consequently, the vent plugs enhance the structural integrity of the shipping container in the event of a fire.

From the foregoing, it will be appreciated that there are a number of significant aspects according to a preferred embodiment of the present invention. For example, the locking retainer ring provides structural integrity for the top upon impact, but is backed up by the retaining bolts securing the top. The spiders maintain the inner vessel and, consequently, the pails containing the radioactive material centered within the outer container, affording stabilized geometry following the impact and fire tests. The outer container is provided with closely spaced annular reinforcing ribs adjacent its top which affords increased shock-absorbing capability and resistance to impact from above the container. The upper and lower dunnages provide impact and fire resistance at the opposite ends of the container. Additionally, all of the materials and fittings are formed of a stainless steel to preclude rust and corrosion. Dimensionally, and as set forth below, the shipping container "fits" into sea van containers in a manner to minimize unused sea van capacity.

Further, the shipping container hereof is readily and easily fabricated. To accomplish this, the lower dunnage is placed in the bottom of the outer container. A disk assembly is bolted to the flange of the inner vessel with the outermost disk having a margin extending beyond the flange of the inner vessel and an outer diameter corresponding to the inner diameter of the outer container. This margin contains a pair of diametrically opposite openings enabling injection of foam into the annular space between the inner vessel and outer container. With the disk assembly applied, the inner vessel is lifted, located and centered within the outer container resting on the lower dunnage. U-shaped channels are provided on both the top and bottom of the outer container and interconnected by tie rods to maintain the inner vessel centered within the outer container during foaming. The foam may then be applied through the openings of the margin of the outer disk. After curing, the disk assembly is removed, the foam maintaining the inner vessel within the outer container. Vent holes are drilled into the sides, bottom and top of the outer container, completing the fabrication.

In a preferred embodiment according to the present invention, there is provided a shipping container for radioactive materials comprising an outer, generally cylindrically-shaped container body having a closed lower end and an open, upper end, a top for releasable securement to the container body and closing the open upper end thereof, a generally cylindrical inner containment vessel generally concentrically disposed in the outer container body for receiving at least one radioactive material containing pail, the inner containment vessel having a lid for closing an open upper end thereof, a foam material between the outer container body and the inner vessel, the inner vessel having an outwardly directed flange about the open end thereof, a plurality of circumferentially spaced reinforcing gussets between an outer surface of the vessel and an underside of the flange for reinforcing the flange, the lid and the flange having cooperating fastening elements for fastening the lid and the flange to one another.

In a further preferred embodiment according to the present invention, there is provided a shipping container for radioactive materials comprising an outer, generally cylindrically-shaped container body having a closed lower end and an open, upper end, a top for releasable securement to the container body and closing the upper end thereof, a generally cylindrical inner containment vessel, generally concentrically disposed in the outer container for receiving at least one radioactive material containing pail, the vessel having a lid for closing an open upper end thereof, a foam material between the outer container and the inner vessel, the inner containment vessel including a plurality of rods projecting outwardly of the vessel toward the outer container body and extending into the foam material for maintaining the inner vessel substantially concentric within the outer container body.

In a still further preferred embodiment according to the present invention, there is provided a shipping container for radioactive materials comprising an outer, generally cylindrically-shaped container body having a closed lower end and an open, upper end, a top for releasable securement to the container body and closing the open upper end thereof, a generally cylindrical inner containment vessel, generally concentrically disposed in the outer container body for receiving at least one radioactive material containing pail, the vessel having a lid for closing an open upper end thereof and a closed lower end, a foam material between the outer container body and the inner vessel, an interior dunnage for the outer container body and overlying the inner containment vessel between the lid thereof and the top for the outer container body, the interior dunnage including a foam material disposed between upper and lower metal sheets and ceramic fiberboard panels and an interior dunnage underlying the inner vessel within the container body, the lower dunnage including foam material disposed between the closed lower end of the vessel and the closed lower end of the container body.

In a still further preferred embodiment according to the present invention, there is provided a shipping container for radioactive materials comprising an outer, generally cylindrically-shaped container body having a closed lower end and an open, upper end, a top for releasable securement to the container body and closing the upper end thereof, a generally cylindrical inner containment vessel, generally concentrically disposed in the outer container for receiving at least one radioactive material container pail and having a lid and neutron absorbing material disposed about the inner vessel and within the outer container body.

In a still further preferred embodiment according to the present invention, there is provided a shipping container for radioactive materials comprising an outer, generally cylindrically-shaped container body having a closed lower end and an open, upper end, a top for releasable securement to the container body and closing the open upper end thereof, a generally cylindrical inner containment vessel, generally concentrically disposed in the outer container body for receiving at least one radioactive material containing pail, the vessel having a lid for closing an open upper end thereof, a heat-resistant fire-retardant foam material between the outer container body and the inner vessel and a plurality of vent holes in the outer container body and plugs sealing the vent holes responsive to a predetermined temperature for opening the vent holes.

In a still further preferred embodiment according to the present invention, there is provided a method of fabricating a container for shipping radioactive materials, including an outer, generally cylindrically-shaped container body having a closed lower end and an open upper end and an inner container for receiving pails of the radioactive materials, comprising the steps of lining the lower end of the outer container body with an insulating material, closing the top of the inner container with a closure member having a peripheral margin laterally outwardly of the periphery of the inner container, locating the inner container within the outer container body forming a generally annular space between the exterior side walls of the inner vessel and interior walls of the outer container body and injecting a self-extinguishing fire-retardant foam material through at least one opening in the closure member and into the annular space.

DETAILED DESCRIPTION OF THE INVENTION

Figure 1:
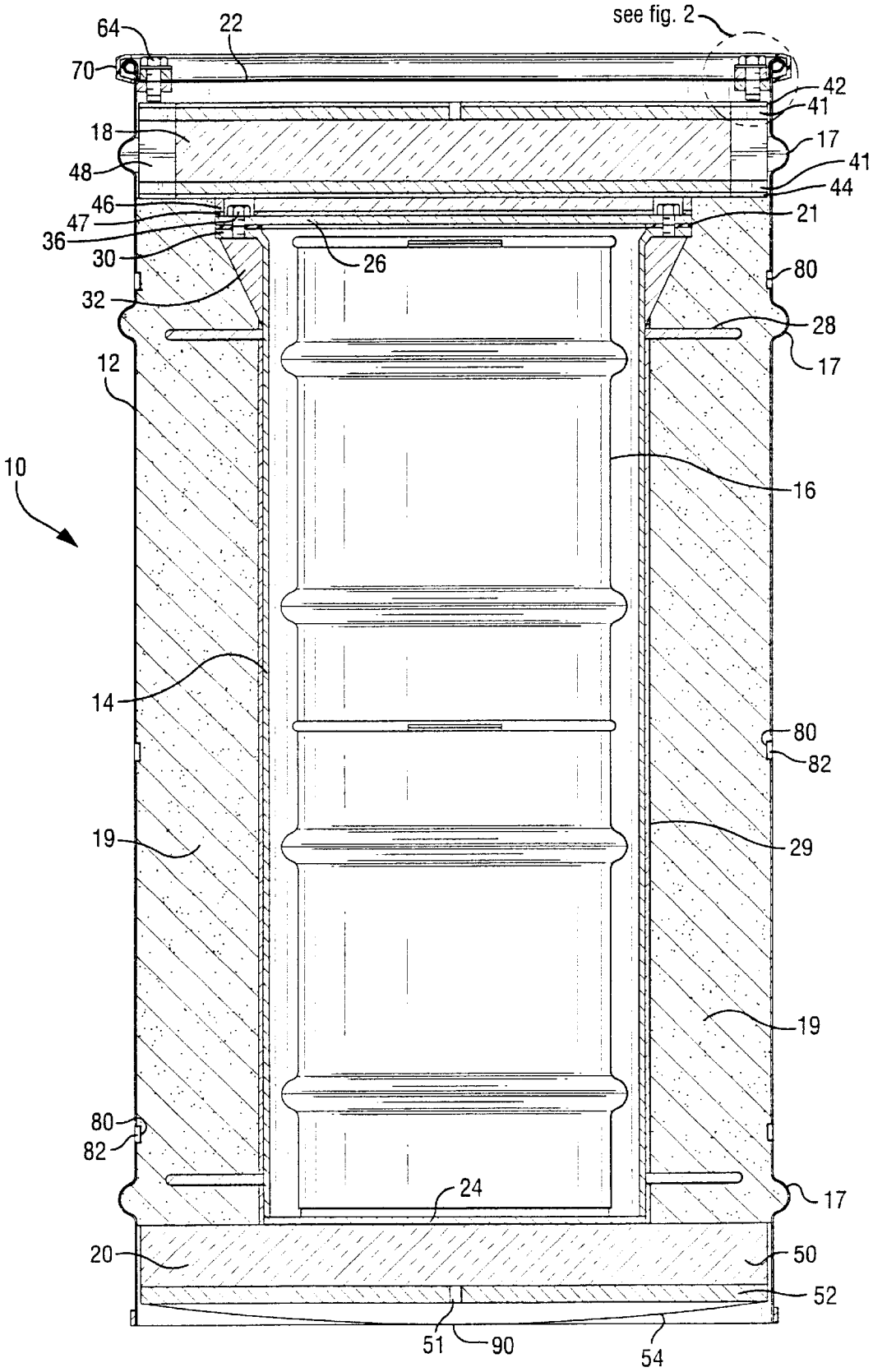
FIG. 1 is a cross-sectional view through a central axis of a shipping container constructed in accordance with a preferred embodiment of the present invention.

Referring now to the drawings, particularly to FIG. 1, there is illustrated a shipping container constructed in accordance with a preferred embodiment of the present invention and generally designated 10. Shipping container 10 includes an outer container 12, an inner containment vessel 14 and a pair of product pails 16 stacked one on top of the other and disposed within the inner containment vessel 14. Shipping container 10 also includes upper and lower dunnages 18 and 20, respectively, and a top 22 for the outer container 12. Outer container 12 is generally cylindrical and preferably fabricated from stainless steel. Reinforcing ribs 17 are formed at axially spaced locations along the container 10 and preferably two such ribs are closely spaced to one another and to the top of the container to reinforce the container, particularly adjacent the top 22. Also, between the outer container 12 and the inner containment vessel 14 is provided a heat-retardant-foam, preferably a polyurethane foam 19.

Figure 4:
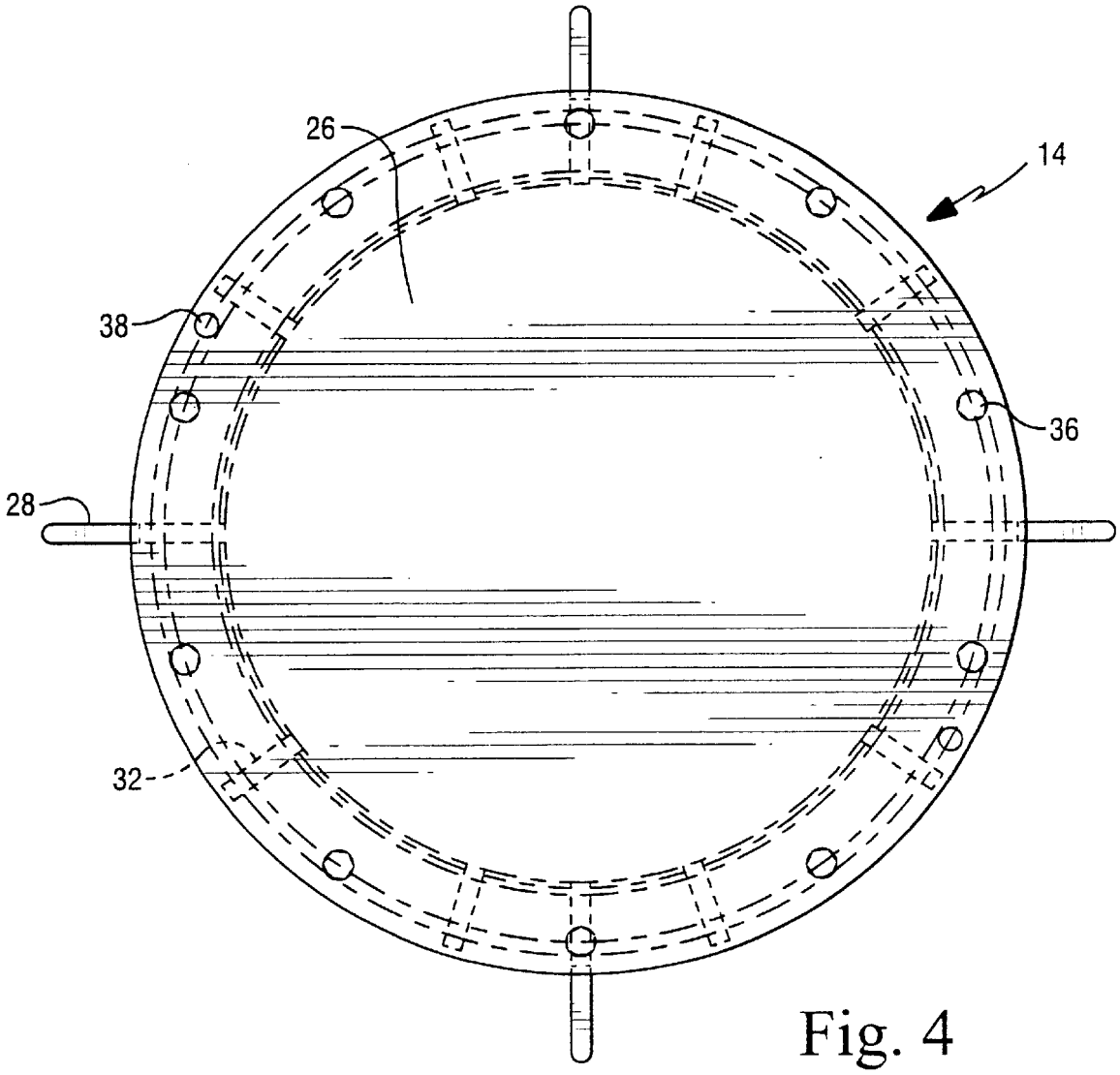
FIG. 4 is a top plan view of the inner containment vessel.
Figure 3:
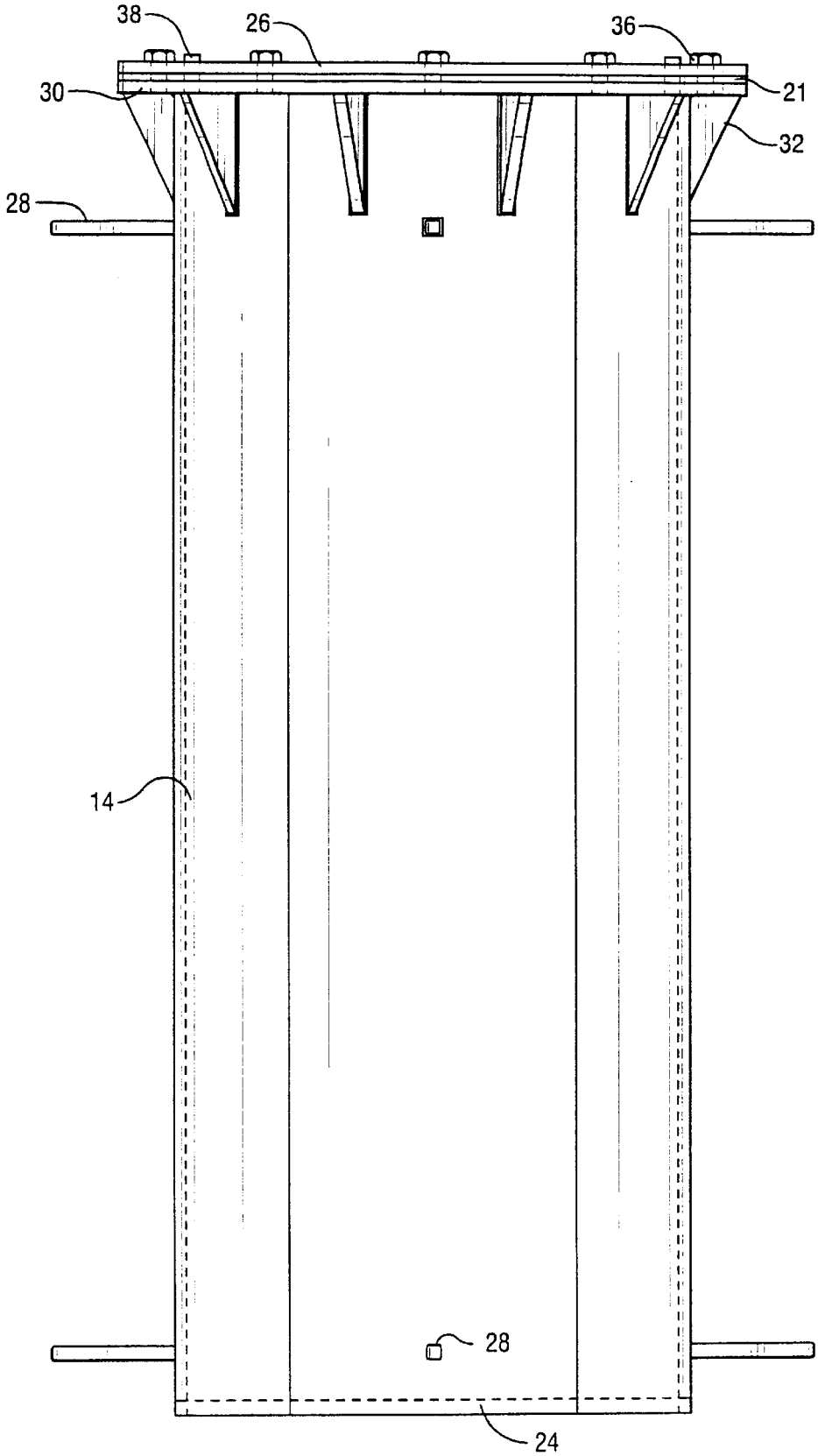
FIG. 3 is a side elevational view of an inner containment vessel.
Figure 5:
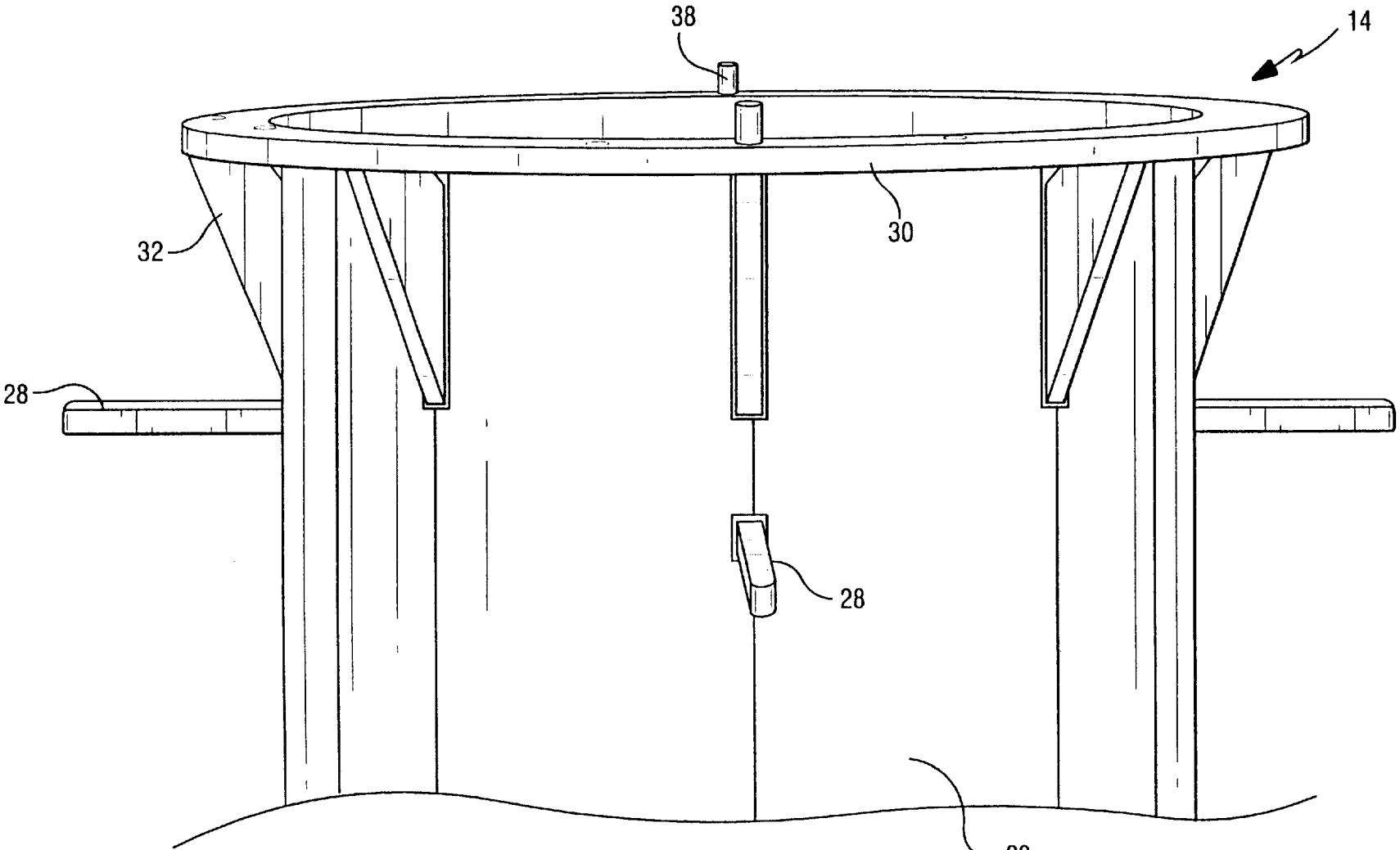
FIG. 5 is a fragmentary perspective view of an upper end portion of the inner containment vessel showing the optional poison panels in place.

Referring now to FIGS. 3, 4 and 5, the inner containment vessel 14 is preferably cylindrical, having a bottom 24 and an open top closed by a lid 26. A plurality of spiders or rods 28 project outwardly, preferably radially, from the cylindrical containment vessel 14 and into the region between the vessel 14 and outer container. 12 to ensure that the vessel remains centered. Preferably, four rods 28 are equally spaced about the periphery of the vessel 14 adjacent its upper end and a similar number and spacing of the rods are provided adjacent the lower end of the vessel 14. The rods 28 extend into the foam which is adhered to the outer container. Consequently, the vessel 14 remains centered within the outer container and is prevented from rotation relative to the outer container.

Additionally, neutron-absorbing material such as cadmium may be provided about the external surface of the inner vessel 14 in the form of poison panels 29. The panels 29 preferably extend between the top and bottom of the inner vessel and may be provided in an arcuate length of 90°. The panels overlie the external peripheral surface of the inner vessel 14 and are provided with openings to receive the spiders 28, as well as the gussets described below. The panels 29 as illustrated in FIG. 1 are overlaid by the foam 19.

An annular flange 30 extends about the periphery of the vessel 14 adjacent its open upper end and projects radially outwardly therefrom. A plurality of gussets 32 are disposed between the upper end of the vessel 14 and the underside of the flange 30 to reinforce the lid sealing region about the open end of the vessel 14. Lid 26 comprises a circular disk overlying the flange 30 and a gasket 21 formed of a fire retardant material is disposed between the lid and flange. The lid has a plurality of predrilled holes for registration with tapped holes in the flange 30 whereby bolts 36 passing through the holes and threaded into the tapped openings secure the lid and gasket to the vessel 14, closing its upper end. As illustrated in FIG. 5, the flange 30 may also mount two or more dowel pins 38 to assist in orienting the lid 26 onto the vessel 14 during installation.

Referring back to FIG. 1, the product pails 16 are preferably formed of 18–20-gauge stainless steel. The product pails are closed containers having a lid with a retaining ring and bolt about the lid securing the lid to the pail. The radioactive material is, of course, located in the product pails.

Figure 6:
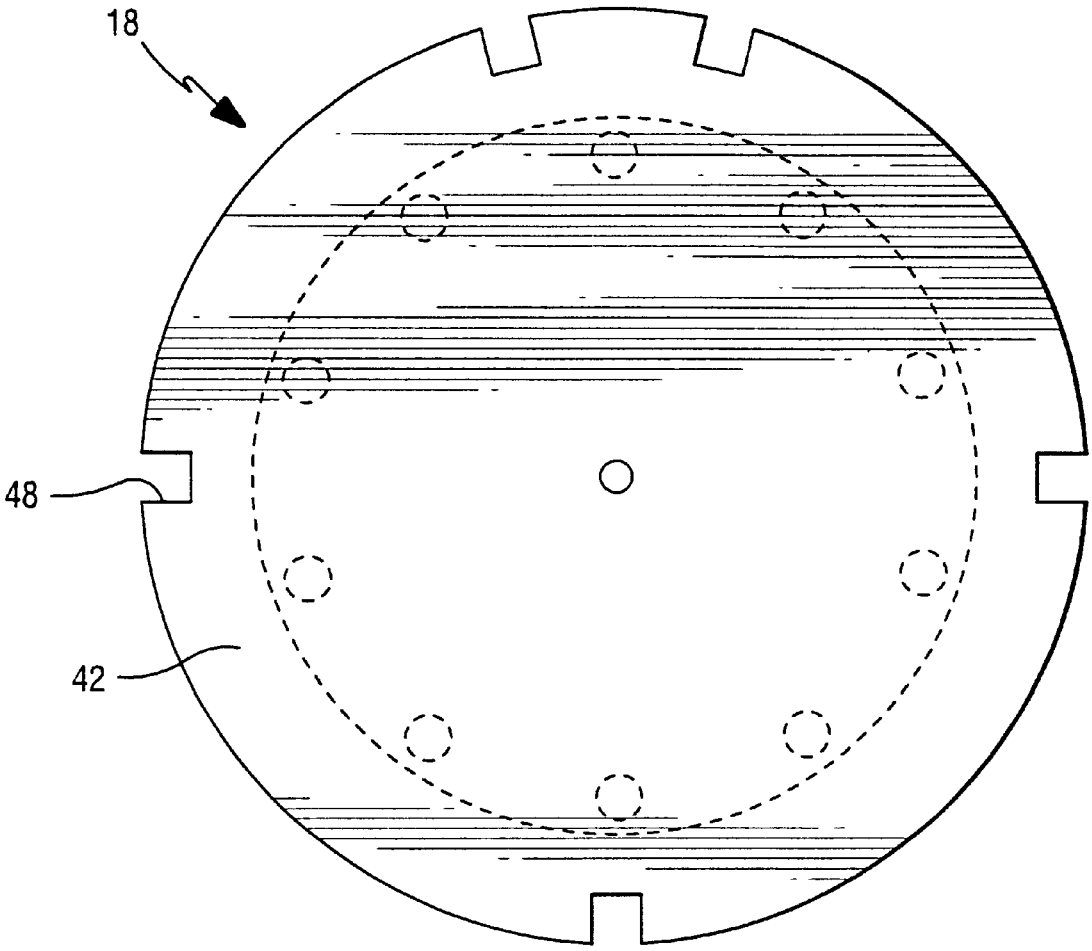
FIGS. 6 and 7 are top and side elevational views of an upper dunnage between the outer container and inner containment vessel.
Figure 7:
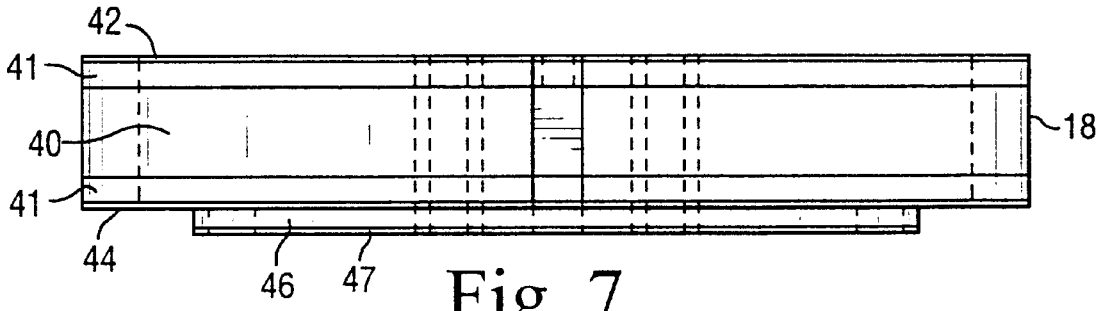
Figure 8:
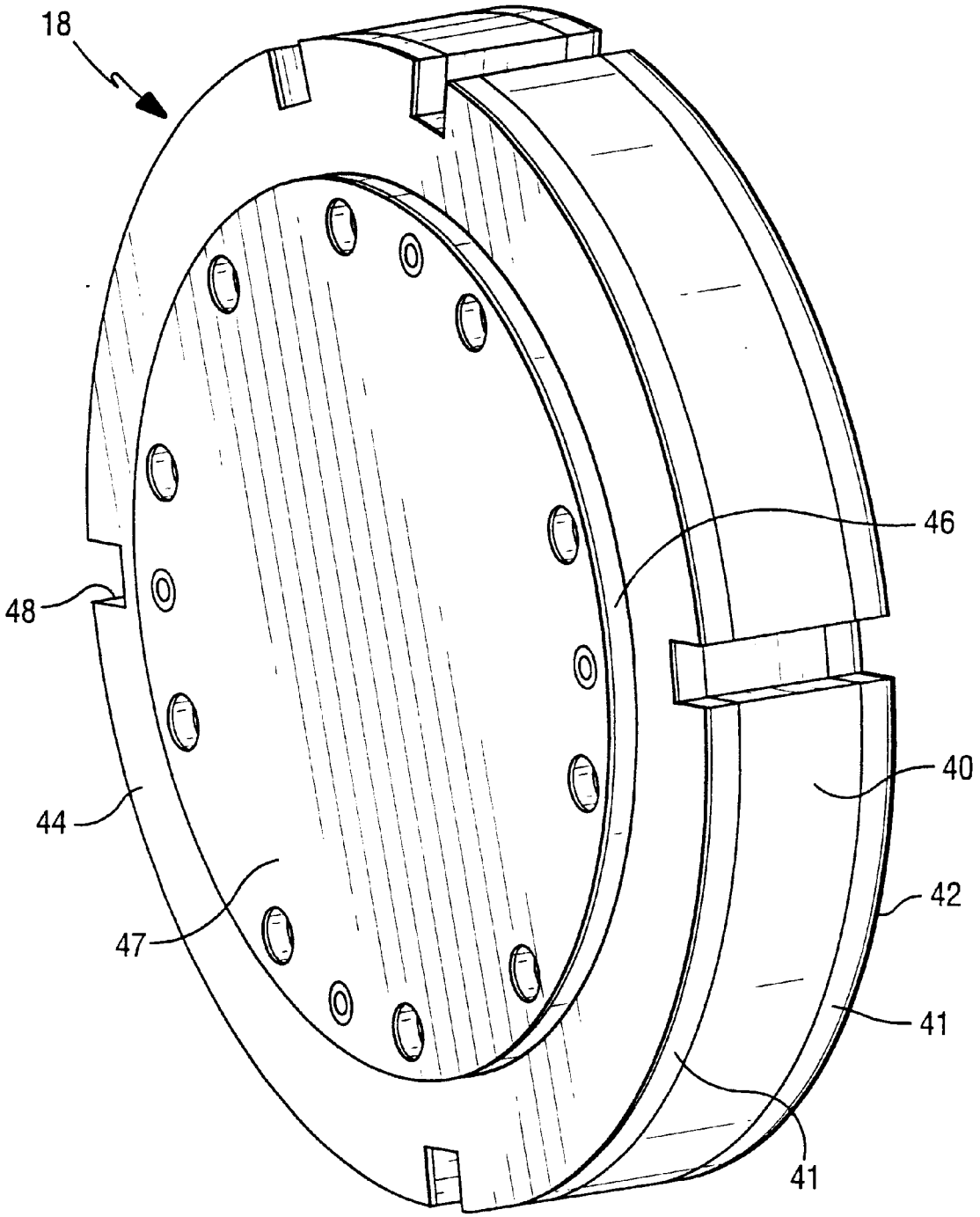
FIG. 8 is a perspective view of the upper dunnage.
Figure 9:
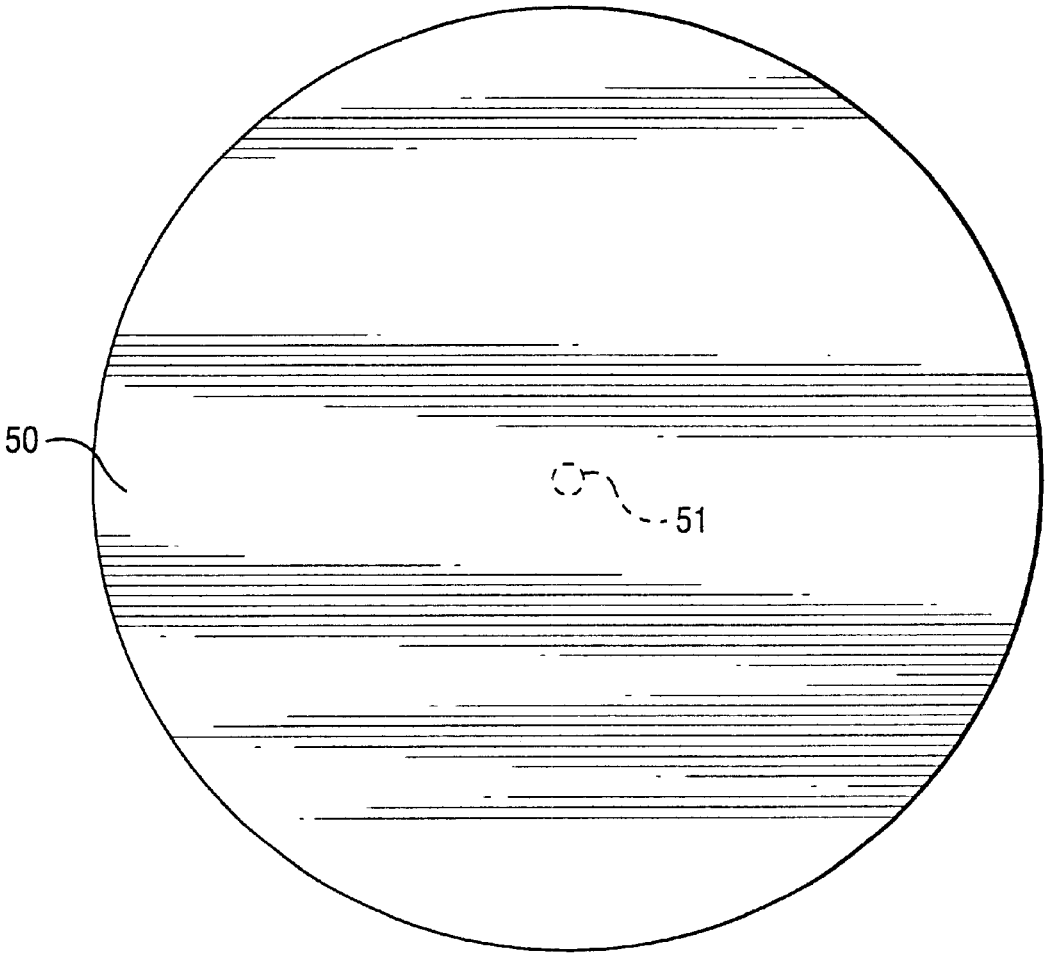
FIGS. 9 and 10 are bottom and side elevational views of a bottom dunnage for the shipping container.
Figure 10:
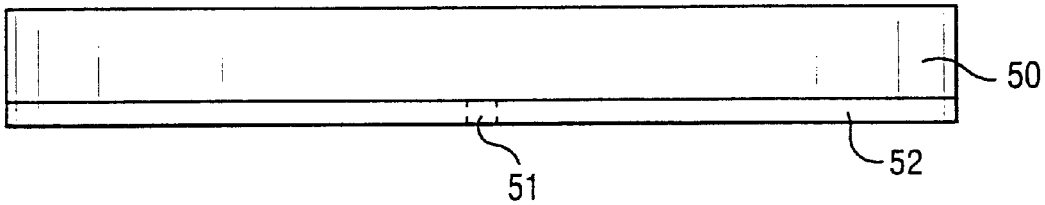

Referring now to FIGS. 6 and 7, the upper dunnage 18 is illustrated. The upper dunnage comprises a foam core and ceramic fiberboard panels 40 and 41, respectively, sandwiched between a pair of plates 42 and 44, preferably formed of 24-guage stainless steel. The plates, as well as the foam and ceramic fiberboard panels, have cutouts 48 along their margins for receiving portions of the bolt lugs used to secure the top 22 to the outer container 12 during assembly as described below. Additionally, a circular ceramic fiberboard panel 46 having an underlayer 47 of stainless steel is secured to the bottom of the upper dunnage 18 to bear against the lid 26 of the inner containment vessel 14 in assembly. The lower dunnage 20 illustrated in FIG. 1 is constructed of a similar upper layer of foam 50 underlaid by a ceramic fiberboard panel 52. The bottom of container 12 is closed by steel plate 54.

Figure 11:
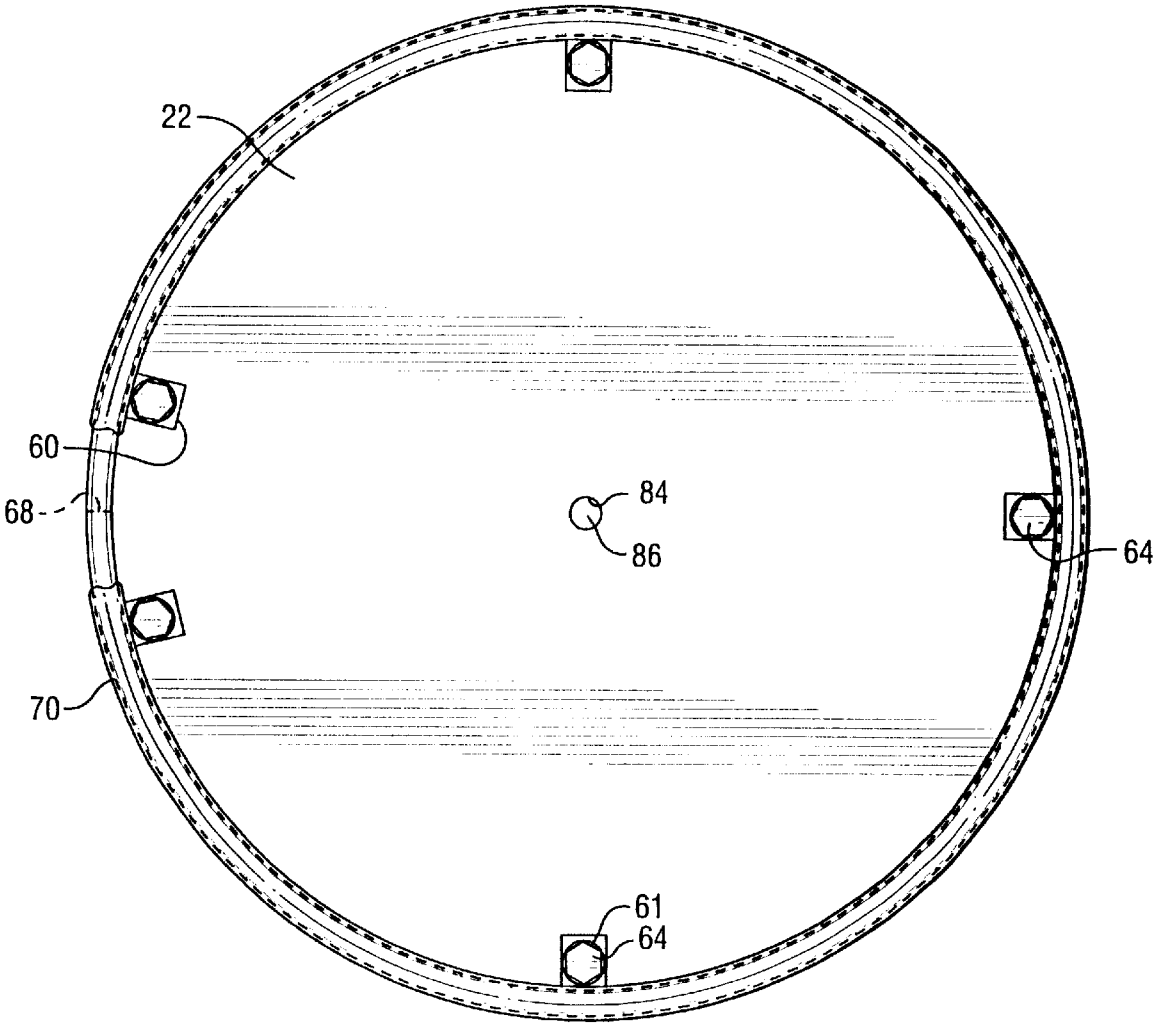
FIG. 11 is a top plan view of the shipping container.
Figure 12:
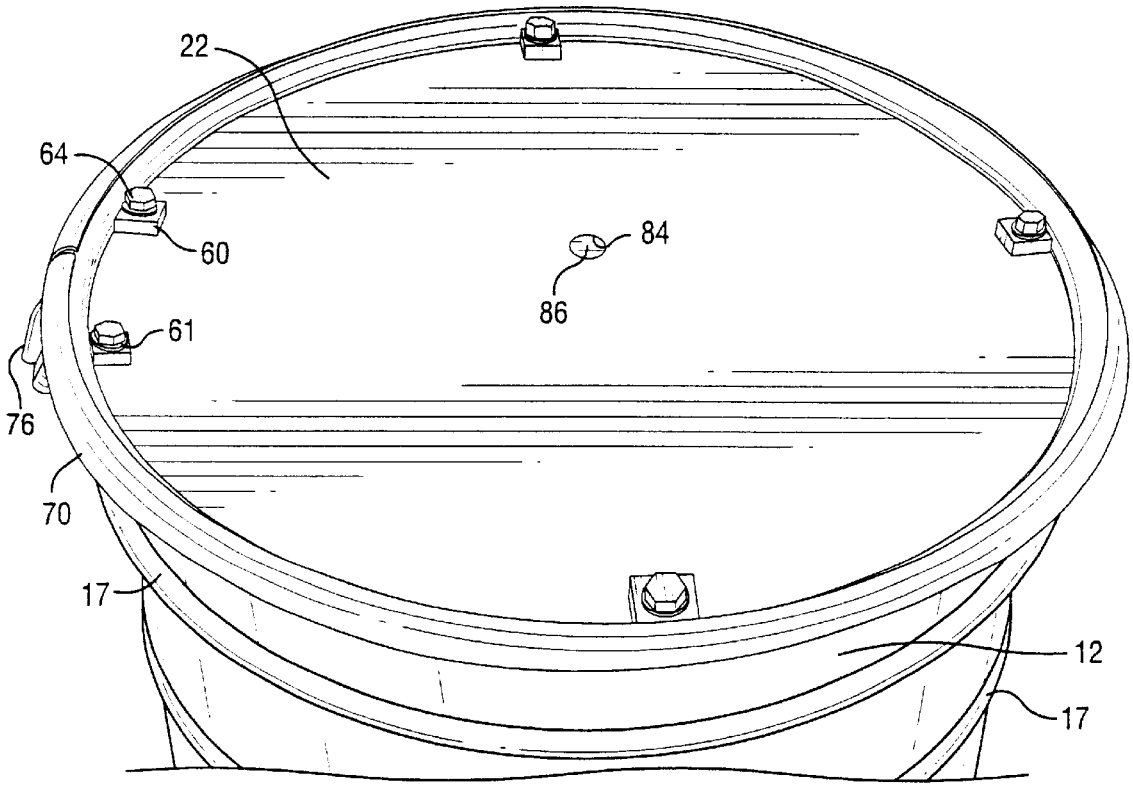
FIG. 12 is a perspective view of an upper end portion of the shipping container.
Figure 13:
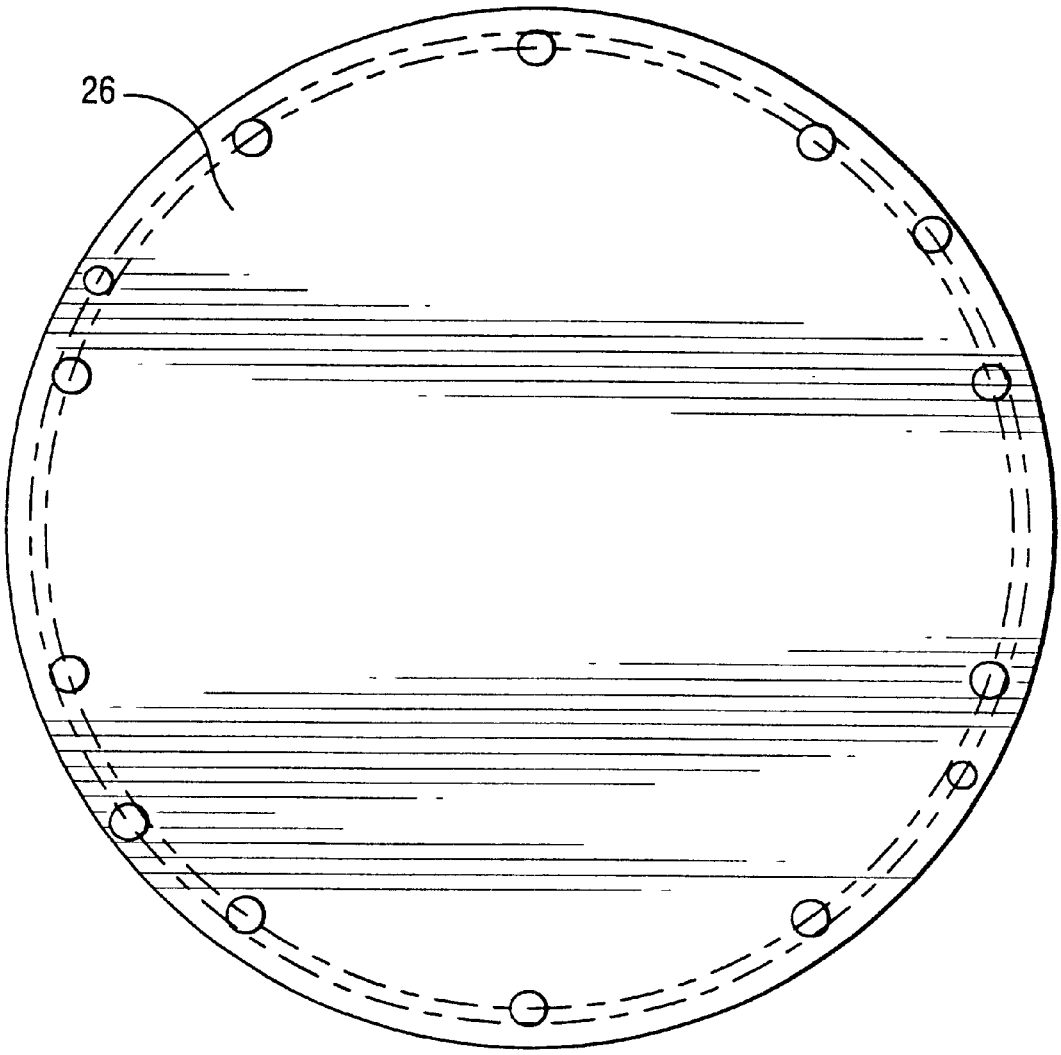
FIGS. 13 and 14 are top and side elevational views, respectively, of an inner lid for the inner containment vessel.
Figure 14:
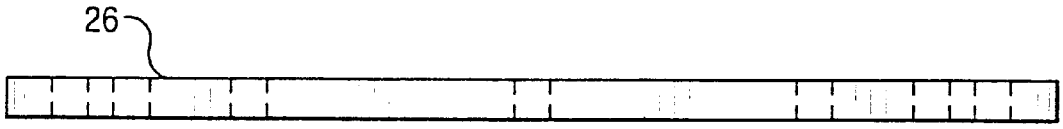
Figure 15:
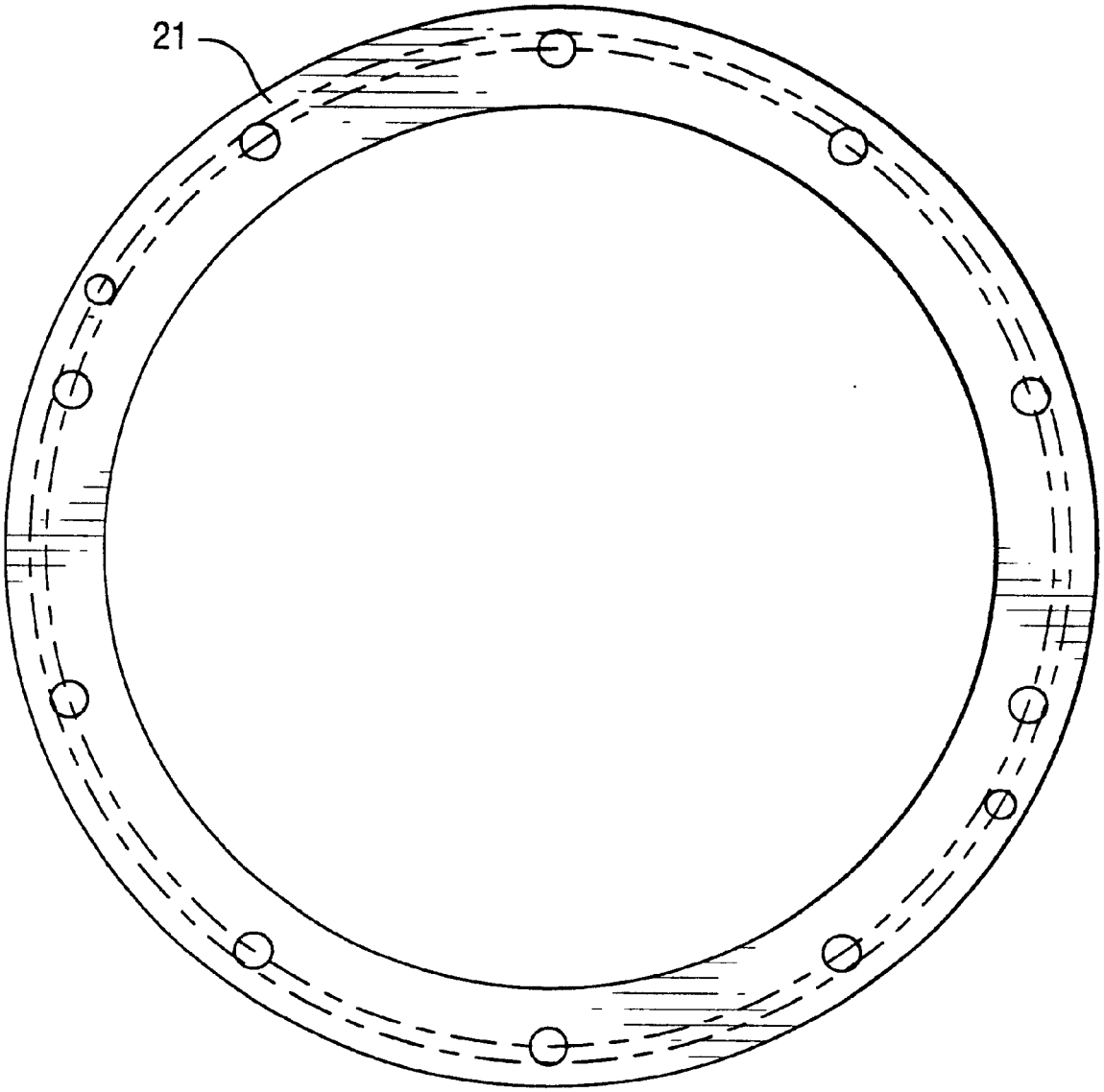
FIG. 15 is a plan view of a gasket for use between the inner lid and inner containment vessel.
Figure 16:
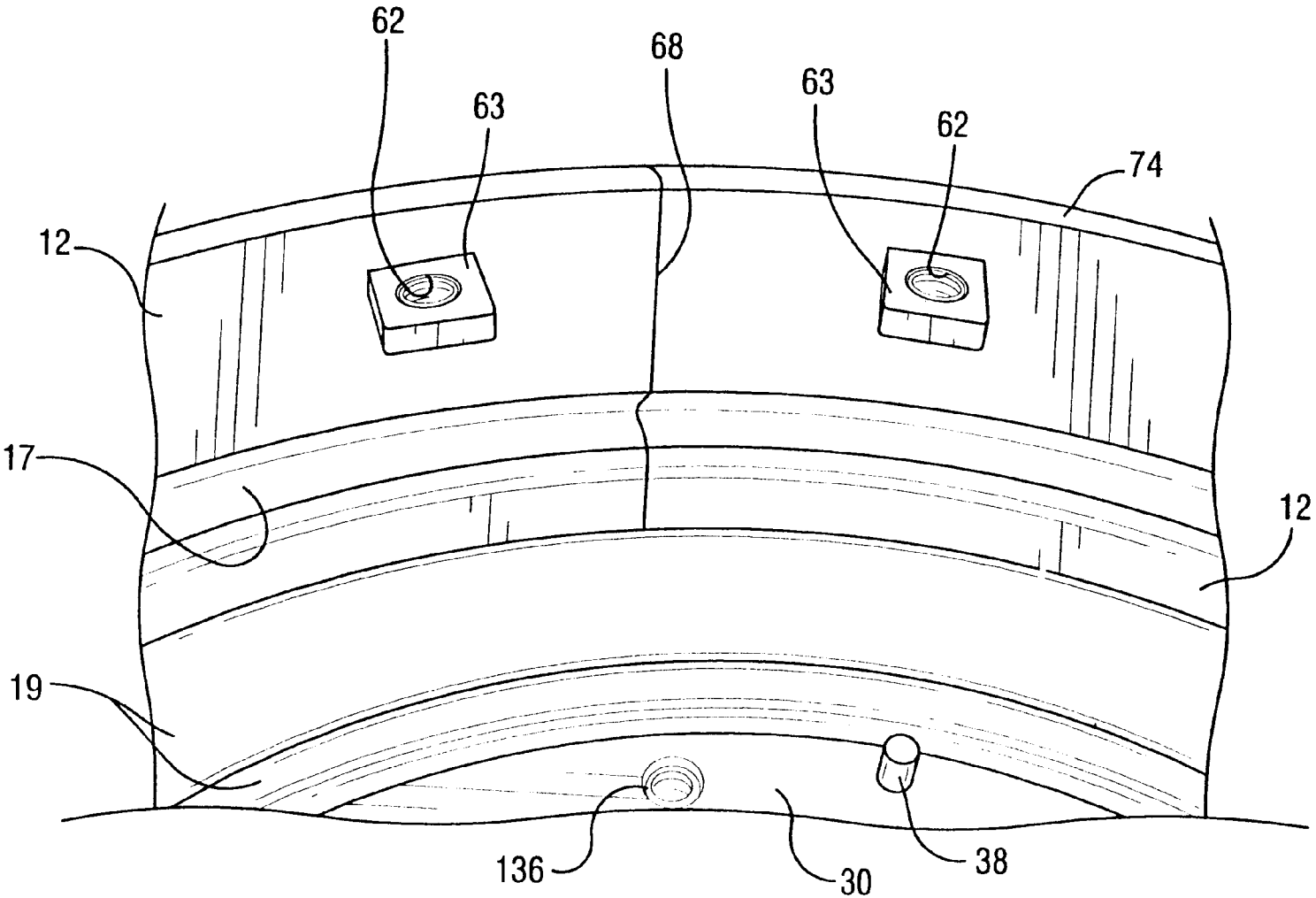
FIG. 16 is a fragmentary enlarged view of an upper end portion of the outer container illustrating the bolt brackets adjacent the seam of the outer container.

Referring now to FIGS. 11, 12 and 16, the top 22 for the outer container 12 is circular and formed from stainless steel. From a review of FIGS. 11, 12 and 16, it will be appreciated that top 22 includes a plurality of bolt holes extending through lugs 60 for threaded engagement with inserts 62 threaded into bolt brackets 63 secured to the inside surface of the outer container 12. The bolts 64 are threaded into the inserts 62 to secure the top 22 with a watertight O-ring seal 61 to the container 12. As seen in FIGS. 11 and 12, three of the bolts 64 and associated lugs, plugs and brackets are spaced 90° from one another about the margin of the top 22. The remaining two bolts are placed approximately 30° from one another and centered on opposite sides of a weld seam 68 extending down the side of the outer container 12. Thus, the bolted connections between the top and the container in the region of the seam 68 provide added reinforcement for the lid.

Figure 2:
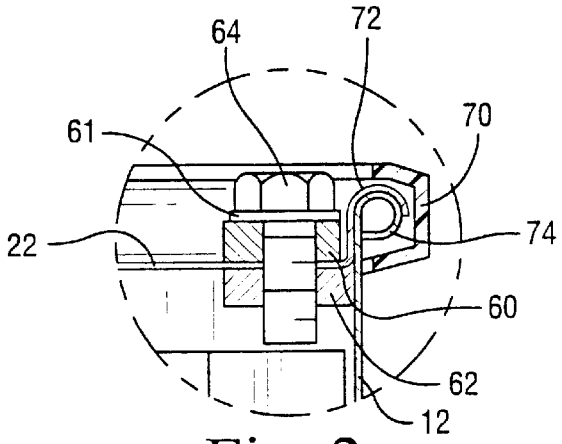
FIG. 2 is an enlarged fragmentary cross-sectional view of the part circled in FIG. 1.
Figure 17:
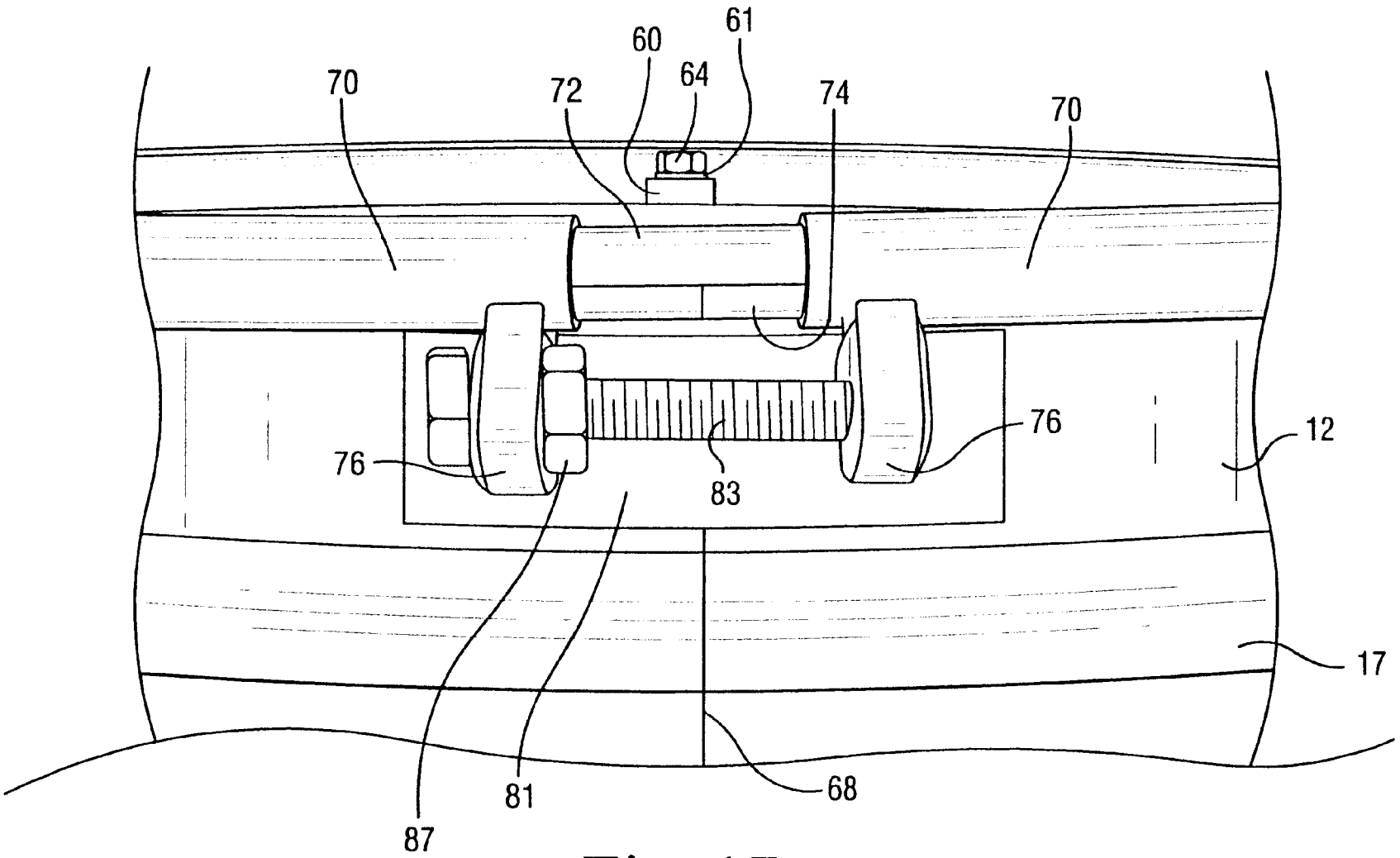
FIG. 17 is a fragmentary enlarged perspective view of a clamping ring for sealing the top of the container to the outer container.

To supplement the securement of the top 22 to the outer container 12 and as illustrated in FIGS. 2 and 17, a heavy-duty retaining ring 70 is applied about the arcuate rolled edge 72 of the top 22 and a beaded rim 74 formed along the upper edge of the outer container 12. The ring 70 terminates at opposite ends in lugs 76 formed to lie close along the outer drum wall rather than projecting radially so that the extent of the projection of the lugs is minimized to avoid shearing of the lugs. As illustrated in FIG. 17, the wall of the outer container immediate the area about the lugs is further supported by a stainless steel plate 81 welded to the outside of the outer drum 12. The steel plate prevents the bolt lugs from cracking the outer drum weld seam 68 due to accidental impact. Additionally, a bolt 83 threadedly secures the lugs 76 to one another. Lock nut 87 keeps the threaded bolt 83 from coming loose while securing the retaining ring 70 about the margin of top 22 and outer container 12 to reinforce the securement of the top and outer container one to the other.

A plurality of vent holes 80 (FIG. 1) are provided at vertically and circumferentially spaced positions about the outer container 12. For example, three vent holes are provided through the container 12 in vertically spaced relation to one another at 90° intervals about the container 12. Each vent hole is sealed by a plastic plug 82. Upon reaching a predetermined temperature, the plastic of the plug 82 melts, opening the vent hole, enabling the escape of expanding gases from within the container. Additionally, and referring to FIG. 11, the top 22 has a vent hole 84 filled with a plastic plug 86. Likewise, the bottom 54 of the container 12 has a central vent hole and a plastic plug. The top and bottom vent holes operate similarly as the side vent holes 80 in FIG. 1 to preclude a buildup of pressurized gases within the container which otherwise might rupture the container. The size and geometry of the invention is such that a standard sea van can accommodate up to 72 containers. Older-style containers had sizes and geometries that would only allow a maximum 54 containers per sea van.

Figure 18:
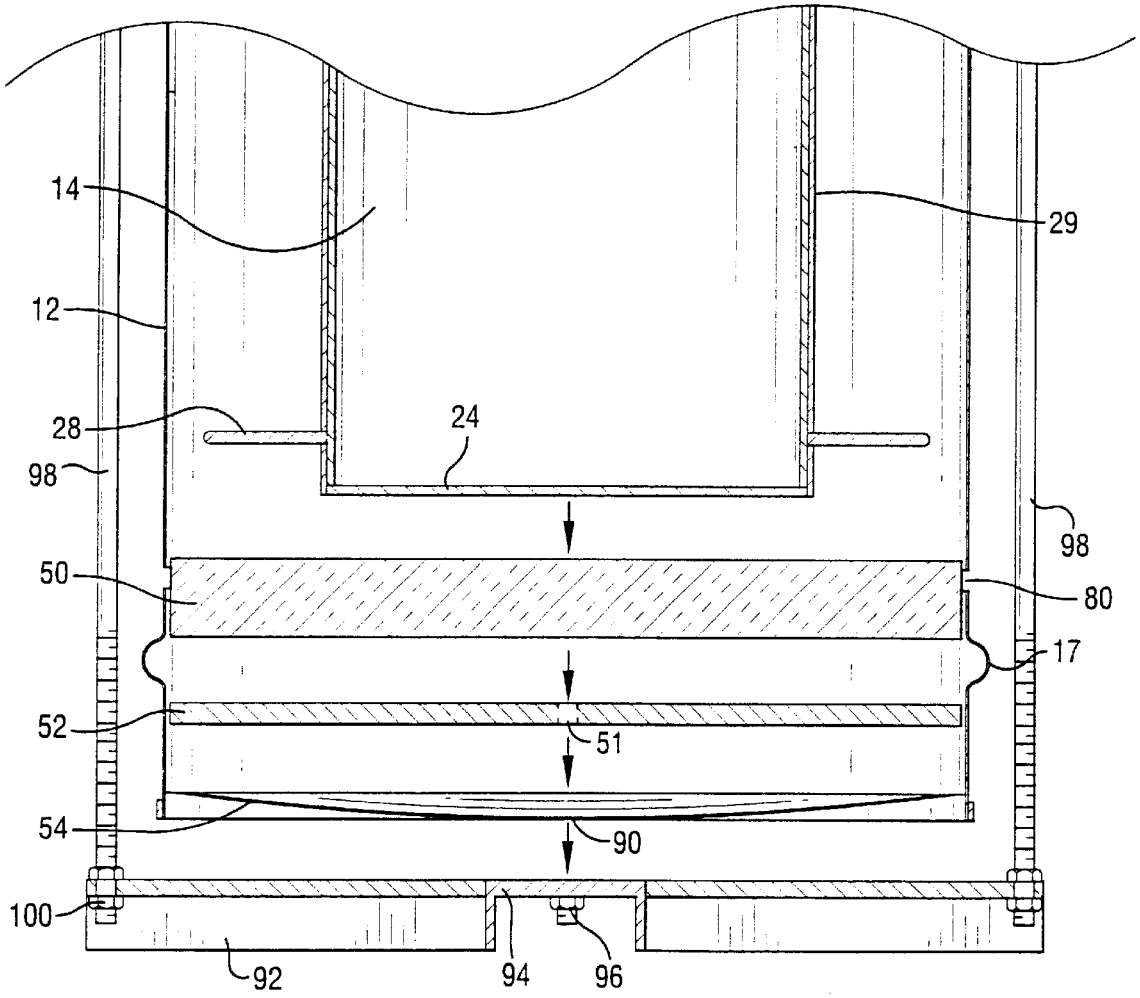
FIG. 18 is a fragmentary cross-sectional view illustrating initial fabrication steps for the shipping container hereof.

Referring now to FIG. 18, which illustrates initial fabricating steps for the shipping container hereof, the bottom 54 of container 12 is provided with a central hole 90. Next, the ceramic fiberboard panel 52 and the layer of foam 50 of the lower dunnage 20 are placed in the bottom of the outer container 12. A fixture assembly is then provided. The fixture assembly includes a pair of channel members 92 and 94 connected at their centers to one another by welding and/or by a bolt 96 and extending at right angles to one another. Each of the channels has a slot at its distal end for receiving the lower end of a threaded rod 98. It will be appreciated that four threaded rods 98 are disposed about the outer container 12 and secured at their lower ends by nuts 100 to the channel members 92 and 94. The outer container 12 is then centered within and on the fixture.

Figure 19:
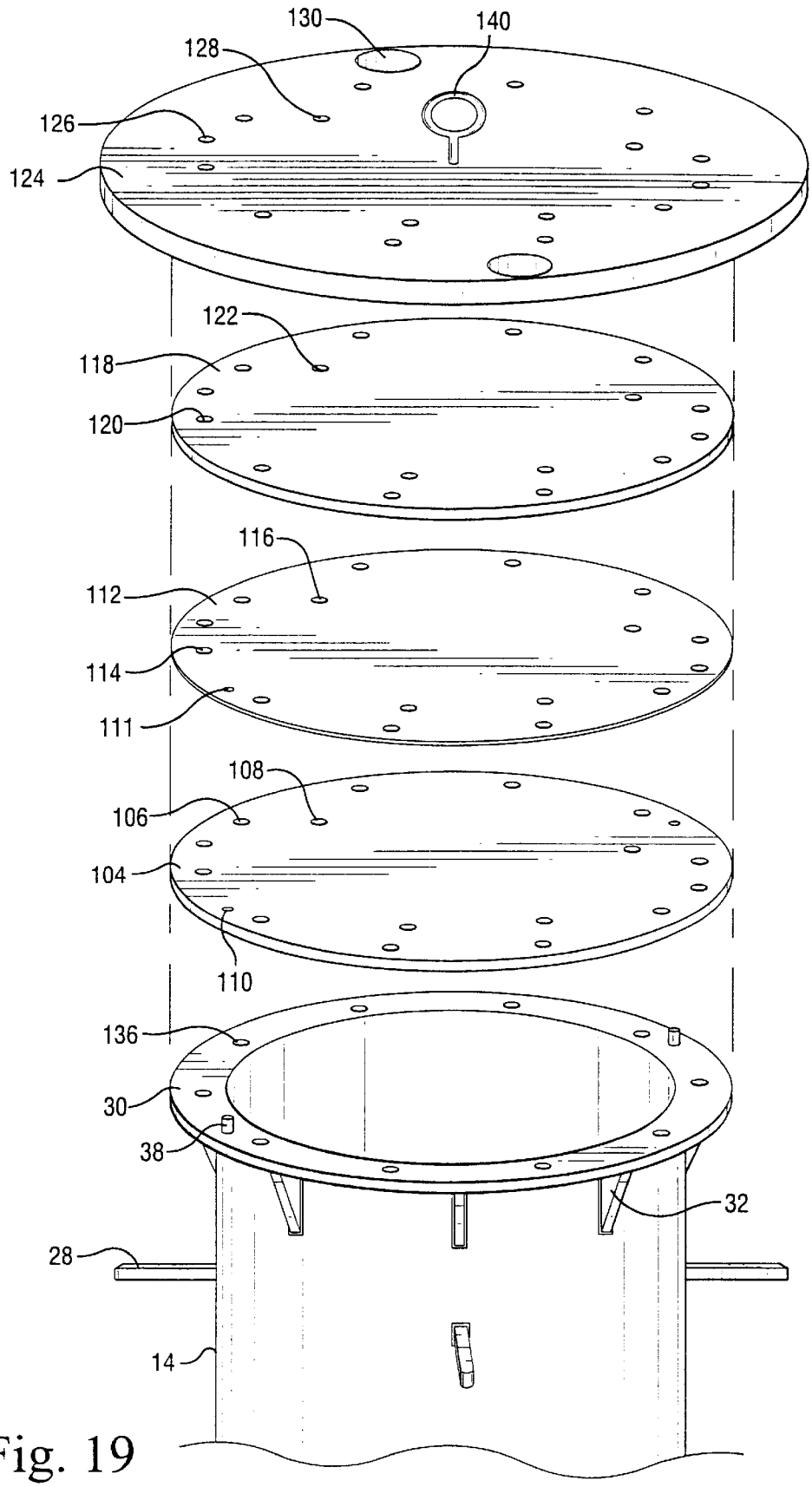
FIG. 19 is a fragmentary perspective view with parts spaced from one another for clarity illustrating further steps in the fabrication of the shipping container hereof.

Referring to FIG. 19, a closure member or disk assembly comprised of a series of disks is disposed on top of the flange 30 of the inner container 14. In the order placed on the flange 30 of inner vessel 14, the disk assembly includes a first disk 104 having a plurality of circumferentially spaced bolt holes 106, vent holes 108 and apertures 110 for receiving the dowel pins 38 formed on the flange 30. Disk 104 is preferably formed of ⅜" thick stainless steel and has an outer diameter corresponding to the outer diameter of flange 30. The next disk 112 is preferably formed of 22-gauge stainless steel having bolt holes 114 and vent holes 116. The third disk 118 is preferably formed of ½" thick aluminum and has bolt holes 120 and vent holes 122. From a review of FIG. 19, it will be appreciated that disks 104, 112 and 118 have like diameters. A final disk 124, preferably formed of ½" thick aluminum, includes bolt holes 126, vent holes 128 and a pair of openings 130 at diametrically opposite locations about the disk 124. The diameter of disk 124 is slightly smaller than the inner diameter of the outer container 12. Additionally, a hook 140 is provided in the center of the top disk 124 for purposes of lifting the inner container 14. In assembling these disks, the vent holes 108, 116, 122 and 128 are aligned with one another and bolts 132 (FIG. 20) extend through the four disks and thread into correspondingly located threaded bolt openings 136 (FIG. 19) in flange 30. It will be appreciated that the dowel pins 38 in this assembly are received in the apertures 110 and 111 of the lower disk 104 and disk 112.

Additionally, a quick-release material is provided along the underside of the margin about the disk 124 which projects beyond the outer diameters of the disks 104, 112 and 118 to facilitate release of the disk assembly from the foam, i.e., prevents the foam from sticking to the fixture during the foaming operation. The inner container 14 with the four disks attached is then lifted, using hook 140, and located and centered in the outer container 12. In placing the inner vessel 14 within the outer container 12, it is aligned with the seam weld 68 along the outer container 12.

Figure 20:
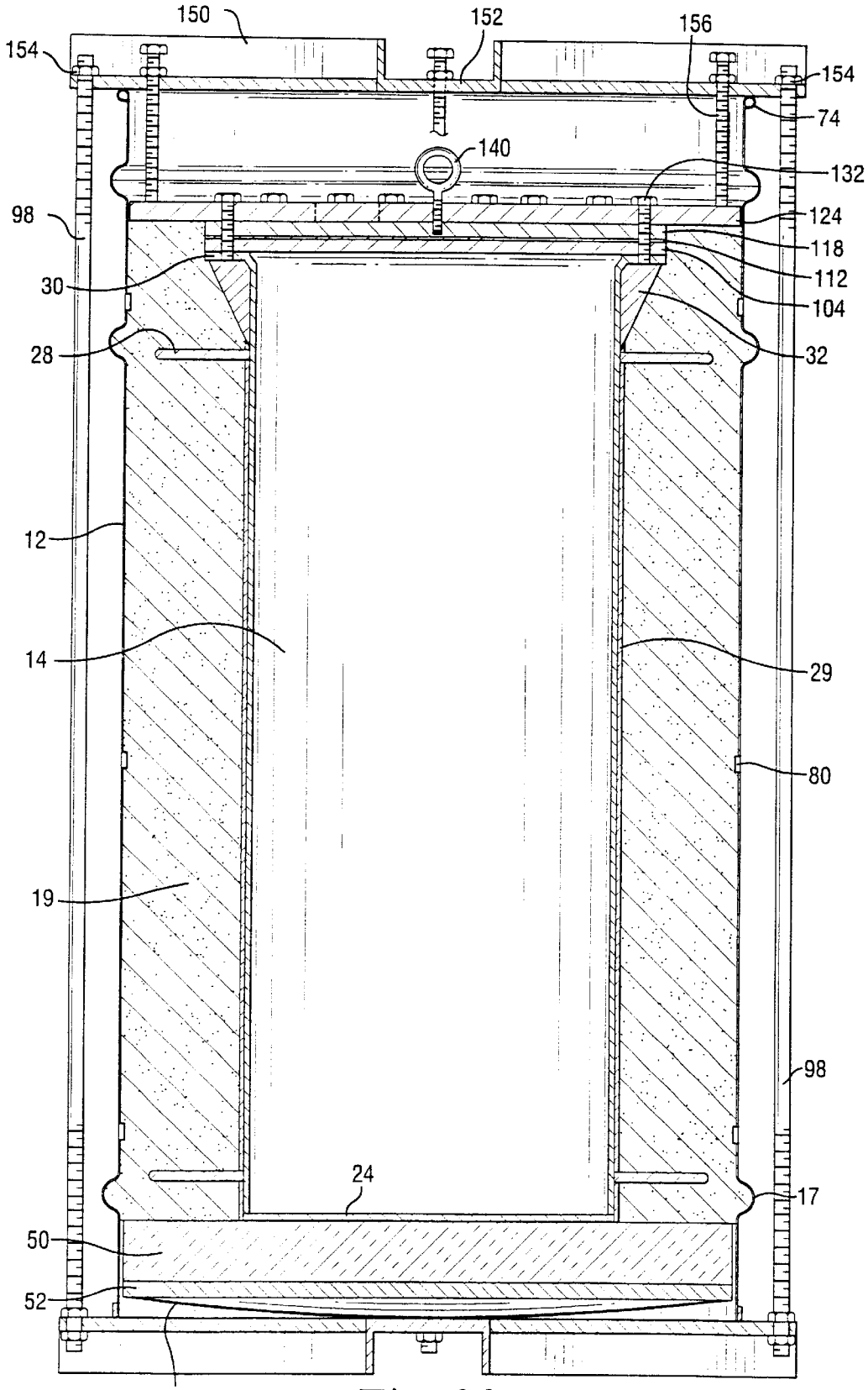
FIG. 20 is a vertical cross-sectional view through the shipping container illustrating the fixtures of the jig for fabricating the shipping container.

Levelers, not shown, are placed on top of the disk 124 to ensure that the inner container is set within the outer container as level as possible. A similar fixturing assembly like 92, 94, 95 and 100 in FIG. 18 is then applied to the top of the inner and outer containers as illustrated in FIG. 20. Particularly, a pair of channel-shaped elements 150 and 152 are located at right angles to one another and secured to one another, extending across the open top of the outer container. The ends of the members 150 and 152 have slots for receiving the upper ends of the threaded rods 98. The rods are secured in place by nuts 154. Elongated bolts 156 extend through the members 150 and 152 and their lower ends engage the upper surface of the upper disk 124, ensuring that the inner container remains level within the outer container 12. The container is now ready for the foaming operation. Foam is injected through the two openings 130 in the upper disk 124 to fill the annular space between the inner vessel 14 and outer container 12. The foam is injected simultaneously through holes 130 and fills the annular space to a level corresponding to an elevation above flange 30 to the bottom side of disk 124, at which time the foaming operation ceases.

After curing, the fixtures, both top and bottom, are removed. Additionally, the disk assembly is removed from the flange 30 of the inner vessel 14. From a review of FIG. 20, it will be appreciated that the spiders 28 extend into the foam 19 securing the inner vessel 14 within outer container 12. Next, the bolt brackets 63 (FIG. 16) are drilled and tapped and the inserts 62 are threaded into the brackets. The brackets 63 are then welded to the inside surface of the outer container 12, with two of the brackets closely straddling the seam 68. A master template gauge, not shown, may be used to locate the brackets about the inner circumference of the outer container 12. The backing plate 80 (FIG. 17) can also be welded to the outer container at this time. Next, a template, also not shown, may be used to locate the lugs 60 (FIG. 12) and holes for drilling through the top 22 for the outer container 12. Additionally, the template may be used to locate the center vent hole 84 in top 22. The lugs 60 are then welded to the top 22. The ceramic fiberboard panel 52 is pre-drilled with a central opening through the openings 84 and 90 in the top and bottom of the outer container 12. A plug 86 is installed in these openings, the bottom one of which is inserted prior to foaming. The upper dunnage 18 is then located overlying the top of the inner vessel 14 and the foam 19, the slots 48 being provided to enable the dunnage 18 to pass by the lugs 63 (FIG. 16). Next, the container's top 22 and outer ring 70 is bolted into place. An opening is drilled through part of the upper dunnage disks 41 and 42 in FIG. 7 for venting purposes. Also, a translucent silicone is used to seal around the lugs 60 on the top of the top 22. An O-ring washer 61 seals bolt 64 to the top 22, making the top 22 completely watertight.

It will be appreciated from the foregoing that there has been provided a shipping container having substantial structural integrity and resistance to fire and water intrusion as well as a quick and inexpensive method of fabricating the container. Importantly, the container provides safety from radiation and criticality while material parts of the shipping container are formed of materials resistant to rust and corrosion, such as stainless steel, whereby the integrity of the container can be maintained over long periods of time and in hundreds of shipments. The structural integrity of the container is enhanced by the retaining ring, the spiders or rods which maintain the inner vessel centered within the outer container and the engagement of the upper and lower dunnages against the top and bottom of the inner vessel, respectively, the dunnages being sandwiched between the vessel and the top and bottom of the container. The arrangement of the reinforcing ribs on the outer container, particularly adjacent the top of the container, reinforce the top of the container, enhancing its resistance to impact. Fire resistance is provided by the combination of foam and ceramic fiberboard panels. Resistance to the destructive effects of high temperatures is also provided by the provision of vent holes disposed and arranged to vent any gases generated within the container upon the container reaching a predetermined temperature. That is, the plastic plugs melt at high temperature and enable the container to be vented. Further, the use of bolt brackets with removably threaded inserts improves the life cycle of the container by permitting the inserts to be removed and replaced by fresh threaded inserts. Consequently, any damage to the bolts or female threads may be readily repaired.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A shipping container for radioactive materials comprising:

an outer, generally cylindrically-shaped container body having a closed lower end and an open, upper end;

a top for releasable securement to the container body and closing said open upper end thereof;

a generally cylindrical inner containment vessel generally concentrically disposed in said outer container body for receiving at least one radioactive material containing pail, said vessel having a lid for closing an open upper end thereof;

a foam material between said outer container body and said inner vessel;

said inner vessel having an outwardly directed flange about said open end thereof;

a plurality of circumferentially spaced reinforcing gussets between an outer surface of said vessel and an underside of said flange for reinforcing said flange;

said lid and said flange having cooperating fastening elements for fastening said lid and said flange to one another.

2. A shipping container according to claim 1 including a gasket formed of heat- and fire-resistant material disposed between said lid and said flange, said foam material comprising a self-extinguishing fire-retardant material.

3. A shipping container according to claim 1 wherein said inner containment vessel includes a plurality of rods projecting outwardly of said vessel toward said outer container body and extending into the foam material for maintaining said inner vessel substantially concentric within said outer container body.

4. A shipping container according to claim 3 wherein said rods project generally radially from said vessel adjacent upper and lower ends of said vessel and at circumferentially spaced locations about said vessel.

5. A shipping container according to claim 1 including an interior dunnage for said outer container body and overlying the inner containment vessel between said lid thereof and said top for said outer container body, said interior dunnage including a foam material disposed between ceramic fiberboard panels and upper and lower metal sheets.

6. A shipping container according to claim 1 wherein said outer container body has a plurality of circumferentially spaced bolt brackets adjacent said top for receiving bolts passed through the top and into the brackets.

7. A shipping container according to claim 6 wherein said outer container body has a seam, a plurality of said bolts being uniformly spaced about said lid and a pair of said bolts straddling said seam and being spaced from one another a distance less than the uniform spacing between said plurality of bolts.

8. A shipping container according to claim 6 including an interior dunnage for said outer container body and overlying the inner containment vessel between said lid of said vessel and said top for said outer container body, said interior dunnage including a foam material disposed between ceramic fiberboard panels and upper and lower metal sheets and having a plurality of circumferentially spaced slots opening through a periphery thereof.

9. A shipping container according to claim 1 including a retaining ring clamping said top to a radially outwardly extending edge of said container body, said ring having end lugs bolted to one another.

10. A shipping container according to claim 1 including a plurality of vent holes in said outer container body and plugs sealing said vent holes responsive to a predetermined temperature for opening said vent holes.

11. A shipping container according to claim 1 including a plurality of reinforcing ribs spaced axially from one another along the outer container body, and a pair of said ribs lying closely adjacent one another and to the open end of the container body for reinforcing the upper end of the container body.

12. A shipping container according to claim 1 including neutron absorbing material disposed about said inner vessel and within the outer container body.

13. A shipping container according to claim 1 including a retaining ring clamping said top to a radially outwardly extending edge of said container body, said ring having end lugs bolted to one another, and a set of bolts and lugs on the top and outer container body for securing the top and the container body to one another.

14. A shipping container according to claim 1 wherein said outer container body has a seam along a side thereof, a metal reinforcement plate overlying said seam to preclude rupture of said seam upon impact.

15. A shipping container for radioactive materials comprising:

an outer, generally cylindrically-shaped container body having a closed lower end and an open, upper end;

a top for releasable securement to the container body and closing said upper end thereof;

a generally cylindrical inner containment vessel, generally concentrically disposed in said outer container for receiving at least one radioactive material containing pail, said vessel having a lid for closing an open upper end thereof;

a foam material between said outer container and said inner vessel;

said inner containment vessel including a plurality of rods projecting outwardly of said vessel toward said outer container body and extending into the foam material for maintaining said inner vessel substantially concentric within said outer container body; and a retaining ring for clamping said top to a radially outwardly extending flange of said container body, said ring having end lugs bolted to one another.

16. A shipping container according to claim 15 wherein said rods project generally radially from said vessel adjacent upper and lower ends thereof and are circumferentially spaced from one another.

17. A shipping container according to claim 15 including interior dunnage for said outer container body and overlying the inner containment vessel between said lid and said top for said outer container body, said interior dunnage including a foam material disposed between upper and lower metal sheets and ceramic fiberboard panels.

18. A shipping container according to claim 15 wherein said outer container body has a plurality of circumferentially spaced bolt brackets adjacent said top for receiving bolts passed through the top and into the brackets.

19. A shipping container according to claim 15 including a plurality of vent holes in said outer container body and plugs sealing said vent holes responsive to a predetermined temperature for opening said vent holes.

20. A shipping container according to claim 15 including neutron absorbing material disposed about said inner vessel and within the outer container body.

21. A shipping container for radioactive materials comprising:

an outer, generally cylindrically-shaped container body having a closed lower end and an open, upper end;

a top for releasable securement to the container body and closing said open upper end thereof;

a generally cylindrical inner containment vessel, generally concentrically disposed in said outer container body for receiving at least one radioactive material containing pail, said vessel having a lid for closing an open upper end thereof and a closed lower end;

a foam material between said outer container body and said inner vessel;

an interior dunnage for said outer container body and overlying the inner containment vessel between said lid thereof and said top for said outer container body, said interior dunnage including a foam material disposed between upper and lower metal sheets and ceramic fiberboard panels;

an interior dunnage underlying said inner vessel within said container body, said lower dunnage including foam material disposed between said closed lower end of said vessel and said closed lower end of said container body; and a retaining ring clamping said top to a radially outwardly extending edge of said container body, said ring having end lugs bolted to one another.

22. A shipping container according to claim 21 wherein said outer container body has a plurality of circumferentially shaped bolt brackets adjacent said top for receiving bolts passed through the top and into the brackets.

23. A shipping container according to claim 21 including a plurality of vent holes in said outer container body and plugs sealing said vent holes and responsive to a predetermined temperature for opening said vent holes.

24. A shipping container according to claim 21 including a plurality of reinforcing ribs spaced axially from one another along the outer container body, and a pair of said ribs lying closely adjacent one another and to the open end of the container body for reinforcing the upper end of the container body.

25. A shipping container according to claim 21 including neutron absorbing material disposed about said inner vessel and within the outer container body.

26. A shipping container for radioactive materials comprising:

an outer, generally cylindrically-shaped container body having a closed lower end and an open, upper end;

a top for releasable securement to the container body and closing said upper end thereof;

a generally cylindrical inner containment vessel, generally concentrically disposed in said outer container for receiving at least one radioactive material container pail and having a lid;

neutron absorbing material disposed about said inner vessel and within the outer container body; and a retaining ring clamping said top to a radially outwardly extending edge of said container body, said ring having end lugs bolted to one another.

27. A shipping container according to claim 26 including a foam material between said outer container and said inner vessel, said inner containment vessel including a plurality of rods projecting outwardly of said vessel toward said outer container body and extending into the foam material for maintaining said inner vessel substantially concentric within said outer container body.

28. A shipping container according to claim 26 including a plurality of vent holes in said outer container body and plugs sealing said vent holes responsive to a predetermined temperature for opening said vent holes.

29. A shipping container according to claim 26 including a plurality of reinforcing ribs spaced axially from one another along the outer container body, and a pair of said ribs lying closely adjacent one another and to the open end of the container body for reinforcing the upper end of the container body.

* * * * *